US009416465B2

(12) United States Patent
Lak et al.

(10) Patent No.: US 9,416,465 B2
(45) **Date of Patent: *Aug. 16, 2016**

(54) PROCESS FOR MAKING A HIGH HEAT POLYMER FIBER

(75) Inventors: Ann Marie Lak, Ludlow, MA (US); Randall Todd Myers, Pittsfield, MA (US); Craig Wojcicki, Pittsfield, MA (US)

(73) Assignee: SABIC GLOBAL TECHNOLOGIES B.V. (NL)

( * ) Notice: Subject to any disclaimer, the term of this patent is extended or adjusted under 35 U.S.C. 154(b) by 733 days.

This patent is subject to a terminal disclaimer.

(21) Appl. No.: 11/457,658

(22) Filed: Jul. 14, 2006

(65) Prior Publication Data

US 2008/0012170 A1 Jan. 17, 2008

(51) Int. Cl.
*D01F 6/74* (2006.01)
*D01D 5/088* (2006.01)

(52) U.S. Cl.
CPC . *D01F 6/74* (2013.01); *D01D 5/088* (2013.01)

(58) Field of Classification Search
USPC ..... 264/167, 169, 172.13, 172.15, 172.17, 264/172.18, 176.1, 177.13, 211.14; 425/72.1, 72.2
See application file for complete search history.

(56) References Cited

U.S. PATENT DOCUMENTS 3,135,811 A * 6/1964 Warner et al. ..... 264/211.14
3,257,487 A * 6/1966 Dulin, Jr. ..... 264/211.15
3,570,059 A 3/1971 Mott
3,802,821 A 4/1974 Mott
3,803,085 A 4/1974 Takehoshi et al.
3,847,867 A 11/1974 Heath et al.
3,850,885 A 11/1974 Takekoshi et al.
3,852,242 A 12/1974 White
3,855,178 A 12/1974 White et al.
3,871,946 A 3/1975 Romanski et al. ..... 161/88
3,905,942 A 9/1975 Takekoshi et al.
3,969,462 A 7/1976 Stofan
3,972,902 A 8/1976 Heath et al.
3,983,093 A 9/1976 Williams, III et al.
4,159,618 A 7/1979 Sokaris ..... 87/251
4,443,591 A 4/1984 Schmidt et al.
4,455,410 A 6/1984 Giles, Jr.

(Continued)

FOREIGN PATENT DOCUMENTS

DE 19514866 11/1995
EP 0053927 A1 12/1981

(Continued)

OTHER PUBLICATIONS

Fujii et al., JP 03-2878081 A, Dec. 1991, Translation.*

(Continued)

*Primary Examiner* — Ryan Ochylski
(74) *Attorney, Agent, or Firm* — Cantor Colburn LLP

(57) ABSTRACT

Various embodiments of a process for making fibers comprising a high heat polymer are provided. In one embodiment, a process for producing polymer fiber includes extruding molten polymer having a melt temperature ranging from about 180-500° C., passing the molten polymer through a plurality of openings of a spinneret to produce a fiber bundle, and contacting the fiber bundle with a cooling medium having a substantially uniform flow distribution across the width of the fiber bundle where the cooling medium has a temperature that ranges from about 0° C. to about 80° C.

46 Claims, 1 Drawing Sheet

(56) References Cited

U.S. PATENT DOCUMENTS

| | | | | |
|---|---|---|---|---|
| 4,485,140 | A | 11/1984 | Gannett et al. | 428/260 |
| 4,640,972 | A | 2/1987 | Irwin | 528/188 |
| 4,650,850 | A | 3/1987 | Howson | |
| 4,725,642 | A | 2/1988 | Gannett et al. | 524/600 |
| 4,794,157 | A | 12/1988 | Berdahl et al. | |
| 4,816,527 | A | 3/1989 | Rock | |
| 4,820,781 | A | 4/1989 | Policastro et al. | |
| 4,847,311 | A | 7/1989 | Yamaya et al. | 524/413 |
| 4,855,391 | A | 8/1989 | Berdahl et al. | |
| 4,931,540 | A | 6/1990 | Mueller et al. | 528/353 |
| 4,943,220 | A * | 7/1990 | Fourne | 425/66 |
| 4,943,481 | A | 7/1990 | Schilo et al. | |
| 4,973,651 | A | 11/1990 | Vora | 528/183 |
| 4,994,544 | A | 2/1991 | Nagahiro et al. | 528/125 |
| 5,013,817 | A | 5/1991 | Ohta | 528/183 |
| 5,043,419 | A | 8/1991 | Ohta et al. | 528/353 |
| 5,061,784 | A | 10/1991 | Mueller et al. | 528/353 |
| 5,131,827 | A | 7/1992 | Tasaka | 418/55.2 |
| 5,150,476 | A | 9/1992 | Statham et al. | 2/93 |
| 5,175,367 | A | 12/1992 | Feiring | 564/309 |
| 5,206,339 | A | 4/1993 | Saruwatari | 528/353 |
| 5,223,556 | A | 6/1993 | Gotoh et al. | 523/215 |
| 5,229,184 | A | 7/1993 | Campbell | 428/113 |
| 5,229,482 | A | 7/1993 | Brunelle | |
| 5,260,121 | A | 11/1993 | Gardner | 428/224 |
| 5,355,567 | A | 10/1994 | Holliday | 28/282 |
| 5,391,419 | A | 2/1995 | Davenport | 428/193 |
| 5,413,852 | A | 5/1995 | Chung et al. | 428/364 |
| 5,447,540 | A | 9/1995 | Kobayashi et al. | 8/654 |
| 5,457,154 | A | 10/1995 | Ohta et al. | 524/600 |
| 5,490,931 | A | 2/1996 | Chung et al. | 210/500.23 |
| 5,525,410 | A | 6/1996 | Hansen | 428/229 |
| 5,573,813 | A | 11/1996 | Custer et al. | 427/346 |
| 5,668,594 | A | 9/1997 | Cahill, III | |
| 5,670,256 | A | 9/1997 | St. Clair et al. | 428/395 |
| 5,688,594 | A | 11/1997 | Lichscheidt et al. | 428/370 |
| 5,694,981 | A | 12/1997 | Stanhope et al. | 139/383 |
| 5,727,401 | A | 3/1998 | Statham | 66/176 |
| 5,788,993 | A * | 8/1998 | Bryner et al. | 425/72.2 |
| 5,840,828 | A | 11/1998 | St. Clair et al. | 528/353 |
| 5,928,971 | A | 7/1999 | Ellis et al. | 442/76 |
| 6,132,476 | A | 10/2000 | Lunsford et al. | 8/531 |
| 6,159,249 | A | 12/2000 | Murakami et al. | 8/529 |
| 6,174,474 | B1 | 1/2001 | Stein et al. | |
| 6,235,662 | B1 | 5/2001 | Zehnder | 442/223 |
| 6,284,864 | B1 | 9/2001 | Roderiguez et al. | 528/272 |
| 6,635,347 | B1 | 10/2003 | Yoshida | 428/395 |
| 6,899,836 | B2 * | 5/2005 | Samant et al. | 264/78 |
| 6,924,350 | B2 | 8/2005 | Dong et al. | |
| 7,005,410 | B2 | 2/2006 | Trinh et al. | 510/287 |
| 7,179,412 | B1 * | 2/2007 | Wilkie et al. | 264/172.11 |
| 7,244,813 | B2 | 7/2007 | Dong et al. | |
| 7,279,440 | B2 * | 10/2007 | Berrigan et al. | 442/409 |
| 7,314,907 | B2 | 1/2008 | Dong et al. | |
| 7,354,990 | B2 | 4/2008 | Hossan et al. | |
| 7,411,014 | B2 | 8/2008 | Gallucci et al. | |
| 7,585,935 | B2 | 9/2009 | Hossan et al. | |
| 2001/0033037 | A1 * | 10/2001 | Nitschke et al. | 264/40.3 |
| 2003/0052432 | A1 | 3/2003 | Osaka et al. | |
| 2003/0216099 | A1 * | 11/2003 | Berrigan et al. | 442/409 |
| 2003/0228812 | A1 | 12/2003 | Stanhope et al. | 442/49 |
| 2004/0052883 | A1 | 3/2004 | McConnell | |
| 2004/0260055 | A1 | 12/2004 | Gallucci et al. | |
| 2006/0084741 | A1 | 4/2006 | Blackburn et al. | |
| 2006/0194070 | A1 | 8/2006 | Croll et al. | |
| 2006/0226573 | A1 * | 10/2006 | Stundl et al. | 264/211.14 |
| 2007/0224422 | A1 | 9/2007 | Fakhreddine et al. | |
| 2008/0006970 | A1 | 1/2008 | Dris et al. | |
| 2008/0012170 | A1 | 1/2008 | Lak et al. | |

FOREIGN PATENT DOCUMENTS

| | | | | |
|---|---|---|---|---|
| EP | 0102536 | A3 | 8/1982 | |
| EP | 0160354 | A3 | 6/1985 | |
| EP | 0736057 | B1 | 12/1994 | |
| JP | 56107005 | | 8/1981 | |
| JP | 01306614 | A * | 12/1989 | D01F 6/74 |
| JP | 03287808 | A * | 12/1991 | |
| WO | 9213119 | A1 | 8/1992 | |
| WO | 2005021648 | A1 | 3/2005 | |
| WO | 2007111890 | A3 | 10/2007 | |

OTHER PUBLICATIONS

De Laney, Donald E. PhD; Tuttle, Kevin and Baxter Brent, "Melt Filtration, an Introduction" from "The Extrusion Technicians Toolbox"; Published by the Society of Plastics Engineers (Jun. 2004).

International Stadard ISO 105-B02; prepared by Technical Committee ISO/TC 38, *Textiles,* Subcommitte SC 1, *Test for coloured textiles and colorants, Part 802: Colour fastness to artifical light: Xenon arc fading lamp test*; Fourth edition Sep. 15, 1994.

ISO 105-B02: 1994(E), Annex A (Normative); *Apparatus for determining colour fastness with air-cooled xenon arc lamps*; Fourth edition Sep. 15, 1994.

ISO 105-B02: 1994(E), Annex B (Normative); *Apparatus for determining colour fastness with water-cooled xenon arc lamps*; Fourth edition Sep. 15, 1994.

ISO 105-B02: 1994(E), Annex C (Informative); *General information on colour fastness to ligh*; Fourth edition Sep. 15, 1994.

Avora FR® Technical Bulletin; Aug. 2005, Invista Specialty Products.

German Application No. 19514866 A1; Filing Date: Apr. 22, 1995; English Translation; 8 Pages.

Albrecht et al.; "Preparation of Highly Asymmetric Hollow Fiber Membranes from Poly (ether imide) by a Modified Dry-wet Phase Inversion Technique Using a Triple Spinneret"; Journal of Membrane Science 262 (2005); pp. 69-80; Elsevier Scientific Publishing Company.

Bohringer et al.; "New Filaments and Fibres of Polyetherimide"; Makromol Chem.; Makromol, Symp. 50;;pp. 31-39 (1991), Huthig and Wepf Verlag, Basel.

German Patent DE2829811; English Translation with Certification; Published Jan. 24, 1980; 59 pages.

Derwent Abstract for XP002463686; Jan. 28, 2008; 1 page.

Abstract of EP0291801 A2; Date of Publication Nov. 23, 1988; 1 page.

International Search Report for International Application No. PCT/US20071071575; mailed Feb. 4, 2008; 7 pages.

Abstract of Japanese Publication No. 3287808; Date of Publication Dec. 18, 1991; 1 page.

Abstract of JP5154892 (A); Date of Publication Jun. 22, 1993; 6 pages.

Written Opinion for International Search Report for International Application No. PCT/US2007/071575; mailed Feb. 4, 2008; 7 pages.

JP 8-296109 with English Abstract; Date of Publication Nov. 12, 1996; 5 pages.

* cited by examiner

PROCESS FOR MAKING A HIGH HEAT POLYMER FIBER

FIELD OF THE INVENTION

The present invention generally relates to a process for making fiber from a high heat polymer. More specifically, the present invention relates to fiber spun from a polymer having a melt temperature that ranges from about 180° C. to 500° C.

BACKGROUND OF THE INVENTION

High melting temperature polymers, such as polyimide polymers having a glass transition temperature that can range from about 180° C. to about 450° C. have found utility in a variety of applications because of their currently extreme physical properties in addition to their heat resistant properties. For example, polyetherimides, available from General Electric Company under the ULTEM® trademark have high glass transition temperatures, are ductile, flame resistant and generate low amounts of smoke while still having good chemical resistivity. These polymers have found wide use in shaped articles, sheet materials, and coatings for use in challenging physical environments such as aerospace applications.

Despite their high processing temperatures, high performance polymers, such as polyetherimides can be made into fibers, however, they require higher processing temperatures not generally used for processing other polymeric fibers. These processing conditions often lead to unexpected and difficult processing issues in the commercial manufacture of articles.

In a conventional system for making polymer fiber, polymer resin is extruded in an extruder and passed through a spinneret containing a plurality of hole openings to form a fiber bundle which is cooled, and drawn to a spool or coil. High performance polymers, such as polyetherimides, require higher processing temperatures not generally used for processing other polymeric fibers. These processing conditions often lead to unexpected and difficult processing issues in the commercial manufacture of articles and fiber. In addition, the output production rate of fibers generated from materials having high melt temperature or high glass transition temperatures are typically low, which limits on the cost-effectiveness for these materials in a variety of product applications. There is therefore a continuing need in the art to develop processes for high heat materials being used to make fibers.

BRIEF SUMMARY OF THE INVENTION

In one embodiment, a process for producing polymer fiber includes melting a polymer having a melt temperature that ranges from about 180° C. to about 450° C. to produce a molten polymer, passing the molten polymer through a spinneret comprising a plurality of hole openings to produce a fiber bundle, and contacting the fiber bundle with a cooling medium having a substantially uniform flow distribution across a bundle width of the fiber bundle as it emerges from the spinneret, where the cooling medium has a temperature that ranges from about 0° C. to about 80° C.

In another embodiment the process for producing polymer fiber includes cooling the fiber bundle by directing the cooling medium toward the fiber bundle through a cooling zone as it contacts the fiber bundle, and wherein the width of the cooling zone is up to about 10% greater than the size of the bundle width.

In yet another embodiment the process for producing polymer fiber includes melting a polymer having a melt temperature that ranges from about 180° C. to about 450° C. to produce a molten polymer, passing the molten polymer through a spinneret comprising a plurality of hole openings to produce a fiber bundle comprising a cross-sectional first region and a cross-sectional second region, the cross-sectional second region having a fiber density that is less than fiber density of the cross-sectional first region.

BRIEF DESCRIPTION OF THE DRAWINGS

The various embodiments of the present invention can be understood with reference to the following drawings. The components in the drawings are not necessarily to scale. Also, in the drawings, like reference numerals designate corresponding parts throughout the several views.

DETAILED DESCRIPTION OF THE INVENTION

Figures 1, 2:
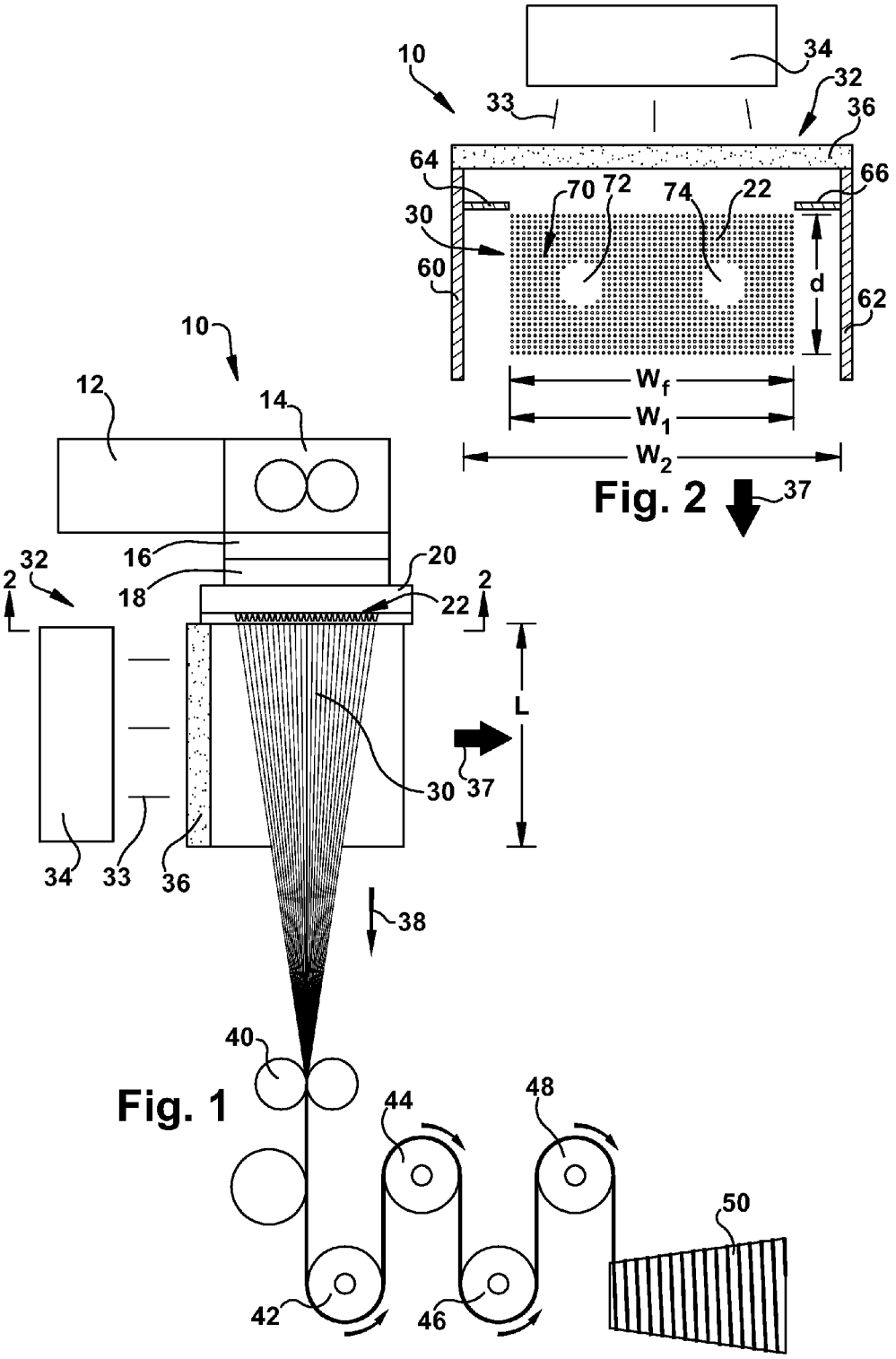
FIG. 1 is a schematic illustration of spinning apparatus according to an embodiment of the invention.
FIG. 2 is a cross-sectional view taken along lines 2-2 of the spinning apparatus of FIG. 1 through the fiber bundle below the spinneret, according to an embodiment of the invention.

According to the present invention the term "Denier" refers to a unit of fineness of silk and some artificial fibers such as nylon equal to one gram per 9,000 meters of yarn.

For purposes of the present invention, the term "polymer" is meant to include oligomers, homopolymers and copolymers.

For purposes of the present invention the term "polyetherimide" refers to a polymer containing monomer units which comprise both a ether and an imide group.

An ether group is well known in the art and consists of an oxygen atom single bonded to two different carbon atoms. An imide group is a nitrogen containing acid having two double bonds.

The term "remove", "removed" and "removing" all refer to the removal of foreign particulate matter from the polymer with which fiber is to be made.

"Filter screen" refers to a woven metal mesh, or gauze, with a specified number of holes per unit area used as a filter. Sintered metal powder or fibers can also be used. The screen mesh may be composed of a square weave or a weave with parallel diagonal lines, sometimes called "Dutch Twill". These screens are generally classified by their mesh number and open area.

"Filter pack" or "screen pack" is a combination of two or more layers of screens or gauze for use in filtering a polymer. For example, a screen pack may be made from an assembly of a 20 mesh, 60 mesh, 100 mesh, 60 mesh and 20-mesh gauzes (designated as 20/60/100/60/20).

"Foreign Particulate Matter" refers to contamination in the extrusion melt stream by extraneous materials (metal, paper, wood, dust, etc.), non-polymeric material which can adversely effect the optimal performance of the fiber and/or the fiber making process according to the present invention. For example, in many high Tg polymers, organic material exposed to the high reaction or processing temperatures, required for making and/or using these polymers can be turned to black specs of carbonized polymer of various sizes. These specs can cause one or more holes in the spinneret to become blocked and cause pressure changes on the inside surface of the spinneret. Such pressure changes adversely affect the speed, volume and quality of fiber. Moreover, if such specs make it through the spinneret, they can become embedded in the fiber, and cause the fiber to have an area of inferior performance, such as a weak spot. Other foreign matter can come from reaction vessels, conduit pipe, shipping packages, unreacted reactants, gels, pre-polymer, process by-products, etc.

The term "rectifier" refers to a device to uniformly diffuse a cooling medium around the fiber bundle emerging from the spinneret.

The term "cooling zone" refers to the cross-sectional area along which the cooling medium is directed toward the fiber bundle that emerges from the spinneret.

The term "substantially uniform flow distribution" refers to the volumetric flow rate of cooling medium across a defined area.

The term "substantially even cooling rate" refers to the substantially even cooling of the individual fibers within the fiber bundle relative to one another.

The term "fiber density" refers to area taken up by the diameter of the fibers of a given region of the fiber bundle relative to the area of the fiber bundle as it emerges from the spinneret. The fiber density of a cross-sectional region of the fiber bundle is the summation of the cross-sectional areas of the fibers in the region divided by the cross-sectional area of the region.

The present invention relates to a process that converts high melting temperature polyimide polymer to fiber having desirable physical and mechanical properties at an improved output rate. It has been found that the production of high melting temperature polymers can be improved by employing heat-management techniques according to the various embodiments described herein.

In one embodiment, process for producing polymer fiber includes melting a polymer having a melt temperature that ranges from about 180° C. to about 450° C. to produce a molten polymer, passing the molten polymer through a spinneret comprising a plurality of hole openings to produce a fiber bundle, and contacting the fiber bundle with a cooling medium having a substantially uniform flow distribution across a bundle width of the fiber bundle as it emerges from the spinneret, where the cooling medium has a temperature that ranges from about 0° C. to about 80° C. The polymer can have a melt temperature that ranges from about 180° C. to about 500° C., in another embodiment from about 180° C. to about 470° C., in another embodiment from about 200° C. to about 450° C., and in yet another embodiment from about 300° C. to about 425° C.

FIG. 1 is a schematic showing spinning apparatus 10 generally used in a process for producing fiber according to an embodiment of the present invention. Molten polymer flows from an extruder 12, into a metering pump 14 and then flows through a pack top 16 having at least one channel (not shown) that leads to a filter 18 to remove foreign particulate matter before the material flows through the spinneret 20 having holes 22, to form a fiber bundle 30 made up of a plurality of individual polymer fibers or filaments. The number of individual fibers in the fiber bundle 30 can depend upon several factors relating to the design of the spinneret 20, such as, for example the hole pattern, the number of holes 22 and sizes of holes 22, and the size and geometric shape of the spinneret to accommodate the holes. For example, there may be anywhere from twenty to several thousand holes in a typical spinneret 20, depending on whether a textile filament, industrial filament, or textile staple is being produced.

The fiber bundle 30 is quenched by quench system 32 which includes a gaseous cooling medium 33, a source 34 that produces the cooling medium, such as for example a motorized fan, and a rectifier 36 through which the cooling medium flows on its path toward the fiber bundle 30. Rectifiers 36 are commonly made from perforated mesh, for example metal or high temperature plastic, or a permeable foam material to provide a uniform velocity distribution across the path of the fiber bundle 30 extruded from the spinneret 20. The rectifier 36 has a predetermined length, L, that defines the length of a cooling zone. The cooling medium flows in a direction represented by arrow 37 and shown, for example, in a direction that is transverse to the path of travel of the fiber bundle 30 which is indicated by arrow 38.

Beyond the quench system 32, the fiber bundle 30 is then further processed through a convergence guide 40 and are then drawn by at least one roll, or godet, for example rolls 42, 44, 46 and 48 and wound on a bobbin or spool 50. Optionally, the process for producing fiber can include a finishing step in which a finish can be applied via a finish applicator (not shown) before the fiber bundle reaches the convergence guide 40.

FIG. 2 is a cross-sectional illustration taken along the lines 2-2 of the spinning apparatus 10 of FIG. 1 and through fiber bundle 30 with a view toward the spinneret 20, according to an embodiment of the invention. As shown, quench system 32 further includes opposing sidewalls 60 and 62 which extend outward from the rectifier 36 alongside the fiber bundle 30 and which contain the flow of cooling medium 33 which flows through the rectifier 36. As shown, sidewalls 60 and 62 span a width $W_2$ that is greater than the width $W_F$ of the fiber bundle 30, however, in alternative embodiments, sidewalls 60 and 62 can also span a width $W_2$ that is approximately equal to the width $W_F$ of the fiber bundle 30, or one of several widths between $W_2$ and $W_F$. In an embodiment in which the distance between sidewalls 60 and 62 is greater that the transverse width $W_F$ of the fiber bundle 30, as shown in FIG. 2, sidewalls 60 and 62 can optionally include a first and a second flow guide 64 and 66, respectively, which allow the cooling medium 33 to be directed toward the fiber bundle 30 through a cooling zone having a width $W_1$.

As shown in FIG. 2 the width of the cooling zone is substantially equal to the width $W_F$ of the fiber bundle 30 as it exits the spinneret 20. Flow guides 64, 66, span a width $W_1$ which is less than the width $W_2$ of sidewalls 60, 62 to help prevent the cooling medium 33 from moving around the fiber bundle 30, thereby causing uneven flow of cooling medium 33 across the transverse width $W_F$ of the fiber bundle 30. The flow guides 64, 66, help thermally manage the flow of cooling medium across the fiber bundle 30 so that all fibers emerging from the spinneret 20 are cooled at a substantially uniform rate. That is, according to an embodiment of the present invention, the process for making polymer fiber includes contacting the fiber bundle with a cooling medium having a substantially uniform flow distribution across a bundle width of the fiber bundle as it emerges from the spinneret. Although the cooling medium exiting the source may have a constant velocity along the cooling zone, the process provides for a contacting the fiber bundle with a substantially uniform flow distribution across the width $W_F$ of the fiber bundle so that the volumetric flow rate of the cooling medium is substantially uniform and the fibers are cooled at a substantially even cooling rate.

In alternative embodiments, sidewalls 60 and 62, or flow guides 64 and 66 can be separated by a distance that extends slightly beyond, or short of, the transverse width $W_F$ of the fiber bundle 30, however, it has been found that if the cooling medium 33 is directed across a width that is substantially greater or substantially less than the transverse width $W_F$, then the polymer filaments can be under-cooled or over-cooled and can break from the fiber bundle 30 thereby decreasing the production output rate of the fiber. That the fibers do not break or drop away from the fiber bundle along the cooling zone due to overcooling or undercooling, is an indication that the fibers are cooled at a substantially even cooling rate. The individual fibers within the fiber bundle cool within a temperature range that prevents the individual fibers from breaking due to overcooling and undercooling. As mentioned above, it is possible that the sidewalls 64 and 66 span a width $W_2$ that is approximately equal to the width $W_F$ of the fiber bundle 30 and no flow guides extending from the sidewalls are present. Accordingly, in an example embodiment the process for producing fiber includes directing the cooling medium through a cooling zone as the cooling medium contacts the fiber bundle, where the width of the cooling zone $W_1$ is up to about 20%, in another embodiment up to about 10%, in yet another embodiment up to about 5% greater than the width $W_F$ of the fiber bundle, and in still yet another embodiment is substantially equal to the width $W_F$ of the fiber bundle 30, and all ranges therebetween.

Thermal management of the high temperature polymer fibers of fiber bundle 30 exiting the spinneret 20 can be achieved by various arrangements of the pattern of holes of the spinneret 20 and the resulting pattern formed by the individual fibers of the fiber bundle 30. The cross-sectional pattern of fiber bundle 30 shown in FIG. 2 substantially reflects the pattern of the holes 22 (FIG. 1) of the spinneret 20 through which the fiber bundle 30 is formed. Fiber bundle 30 has a cross-sectional first region 70 and a cross-sectional second region 72, in which the fiber density of the first region 70 is greater than the fiber density of the second region 72. It has been found that in a process for producing fiber, a spinneret 20 having at least two regions each of which has a different hole density and which produces a fiber bundle 30 having at least two cross-sectional regions of different polymer fiber density, results in improved productivity of the fiber.

The hole density of a particular region of the spinneret 20 is herein defined as the ratio of the open area of the holes of the region divided by the area of the region. The fiber density of a particular region is herein defined as the cross-sectional area of the fibers in the region divided by the cross-sectional area of the region.

In the example embodiment of FIG. 2, fiber bundle 30 has a cross-sectional first region 70 that surrounds a cross-sectional second region 72, and the fiber density of the first region 70 is greater than the fiber density of the cross-sectional second region 72. The fiber density of the cross-sectional second region of fiber bundle 30 is determined by the hole pattern of a second portion of the spinneret 20 (not shown) and opposite the cross-sectional second region of the fiber bundle 30, having a hole density that is less than the hole density of the first portion of the spinneret 20. The fiber density of the cross-sectional second region 72, as shown in FIG. 2, is substantially zero, however, the fiber density of the second region 72 can be any fiber density that is less than the fiber density of the first region 70. For example, the cross-sectional second region 72 of fiber bundle 30 can have a sparse arrangement of fibers relative to the cross-sectional first region 70 of the fiber bundle 30. The region that has a relatively lower polymer filament density can reduce the heat build-up within the fiber bundle 30, has been found to promote substantially even cooling of the fibers and result in increased productivity for the process of producing the fiber. The individual fibers of the cross-sectional first region 70 are shown as equally spaced apart, however, the filaments of cross-sectional first and second regions 70 and 72 may each be evenly spaced apart or irregularly spaced apart.

The area of the cross-sectional second region 72 can be less than the area of the cross-sectional first region 70, in another embodiment, the cross-sectional second region is at least about 5% of the area of the cross-sectional first region, in another embodiment from about 5% to about 50% of the area of the cross-sectional first region, in yet another embodiment from about 10% to about 20% of the area of the cross-sectional first region, and all ranges therebetween. The fiber density of the cross-sectional second region 72 is less than about 90% of the fiber density of the cross-sectional first region 70, in another embodiment less than about 50%, in another embodiment less than about 25%, and in yet another embodiment, the fiber density of the second region is substantially zero.

In another embodiment, the fiber bundle 30 can include a cross-sectional third region 74 that is surrounded by the cross-sectional first region 70, and having a fiber density that is less than the fiber density of the first region 70. The fiber density of the third region is determined by a third portion of the spinneret 20 (not shown) having a hole density that is less than the hole density of the first portion of the spinneret 20. In the example embodiment shown in FIG. 2, the fiber density of the third region 74, like the second region 72, is substantially zero, however, the fiber density of the third region 74 can be any fiber density that is less than the fiber density of the first region 70. For example, the cross-sectional third region 74 is at least about 5% of the area of the cross-sectional first region 70, in another embodiment from about 5% to about 50% of the area of the cross-sectional first region, in yet another embodiment from about 10% to about 20% of the area of the cross-sectional first region, and all ranges therebetween. The fiber density of the cross-sectional third region 74 is less than about 90% of the fiber density of the cross-sectional first region 70, in another embodiment less than about 50%, in another embodiment less than about 25%, and in yet another embodiment, the fiber density of the third region is substantially zero. Moreover, the fiber bundle 30 can include additional regions (not shown) having varying fiber density. For example, each of these additional regions can be surrounded by the first region 70 and can have a fiber density that is less than the fiber density of the first region.

The fiber density of the third region can be the same or different than the fiber density of the second region 72. In one embodiment, the fiber density of each of the second region 72 and third region 74 of the fiber bundle 30 can be about 95% or less, in another embodiment about 80% or less, and in yet another embodiment about 50% or less than the fiber density of the first region 70. In another embodiment, the fiber density of each of the second region 72 and the third region 74 can range from about 20% to about 95%, in another embodiment from abut 20% to about 80%, and in yet another embodiment from about 30% to about 70% of the fiber density of the first region 70.

The cross-sectional second region 72 and third region 74 are shown to be substantially circular in shape, as determined by a hole pattern of the spinneret 20 which is substantially circular in shape, however, these regions can be one of many various shapes, for example, rectangular, triangular, etc., and the shape of the second region 72 can be different than the shape of the third region 74.

Thermal management of the high heat generated by the polymer passing through the spinneret 20 to form a fiber bundle 30 according to the embodiments described above promotes uniform flow of cooling medium across the fiber bundle 30 to substantially equilibrate the cooling rate of each of the individual fibers within the fiber bundle. The embodiment shown in FIG. 2 shows a spinning apparatus 10 for a process in which the cooling medium is directed by sidewalls 60 and 62 or protrusions 64 and 66, as described above, or the spinneret includes at least two regions of different hole density to produce a fiber bundle 30 having at least two regions of different fiber density. However either of the above-described thermal management techniques may be employed separately depending upon the desired output rate of the fiber as well as several other factors pertaining to the polymer, for example, the melt index, the melt temperature, as can be determined by one of ordinary skill in the art.

The fiber bundle exiting the spinneret can be cooled with a cooling medium having a temperature that ranges from about 0° C. to about 80° C. to produce fibers depending on the particular composition of polymer comprising polyetherimide. In another embodiment, the cooling medium has a temperature that ranges from about 0° C. to about 40° C., and in yet another embodiment, the cooling medium has a temperature that ranges from about 10° C. to about 24° C. The cooling medium can be a liquid, for example water, or a gas, for example air. The cooling medium can be directed toward the fiber bundle as it emerges from the spinneret, and can have at a substantially uniform velocity distribution. For example the gaseous cooling medium directed toward the fiber bundle ranges from abut 0.01 to about 20 meters per second, in another embodiment from about 0.01 to about 10 meters per second, in yet another embodiment from about 0.05 to about 5 meters per second, and all ranges therebetween. Velocities which are too high can cause fibers to break, depending upon the composition of the polymer and the diameter of the fiber, for example.

Productivity output rates of fiber from at least about 100 meters/minute up to and including 7500 meters/minute can be achieved. In another embodiment, the output rates can range from about 100 meters/minute to about 5,000 meters/minute, in another embodiment from about 500 meters/minute to about 5,000 meters/minute. In still yet another embodiment, the output rates of fiber can range from about 750 meters/minute up to and including about 4000 meters/minute.

The size of the holes in the spinneret are directly related to the size of the fiber exiting from the spinneret. The spinneret can have a variety of number of holes depending on the volume, denier, commercial requirement or end properties of the fiber to be produced. For example, the spinneret can have from about 1 (to produce very thick, i.e. 2.00 mm fibers) to about 3000 holes, or in another embodiment from about 30 to about 1000 holes. In yet another embodiment, the number of holes can range from about 60 to about 850, alternatively from about 100 to about 800 holes, and for example from about 400 to about 700 holes, and all ranges therebetween.

The spinneret holes can be of any diameter that will produce a desired denier fiber. Diameters can range from 0.001 mm up to about 3 cm, in another embodiment from about 0.1 mm up to about 1 cm, and for example can range from about 0.3 mm up to about 5 mm. In many circumstances, the diameter of the spinneret hole will be directly related to the denier of the fiber to be produced. For example, a spinneret hole diameter of from 0.45 mm to 0.6 mm will produce a fiber from about 2 to 4 denier using ULTEM® 9011, a commercially available PEI from GE Plastics, Pittsfield, Mass., USA.

The thickness of the fiber according to the present invention is preferably between 0.1 and 100,000 dpf (denier per filament), or, in another embodiment, from about 0.1 dpf to about 100 dpf, in another embodiment from about 0.1 dpf to about 50.0 dpf, and in yet another embodiment from about 0.25 dpf to about 10.0 dpf, or still yet further from about 0.25 dpf to about 1.0 dpf. In accordance with an embodiment of the present invention, a polymer fiber may range from about 1 dpf to about 20 dpf, in another embodiment, less than about 10 dpf, for example 2 dpf, 4 dpf, and 6 dpf. Depending on the end use of the fiber, other dimensional characteristics may also be employed to describe the fibers according to the present invention. For example, dyed fibers also include those from 0.01 dpf through 50,000 dpf, or for example, 0.1 dpf to about 100 dpf.

The fiber may also be measured characterized in terms of its diameter which can range from about 0.00001 mm to about 2 mm, for example from about 0.0001 mm to about 0.5 mm, and as another example, from about 0.005 mm to about 0.5 mm, and still yet in another example from about 0.005 mm to about 0.095 mm. The skilled artisan will appreciate that these ranges include different breadths depending on the spinneret hole measurements and the use of the fiber and that the present invention is intended to encompass the entire range of sizes of polyetherimide fiber.

The produced fiber may be either of a continuous filament shape or cut into a short staple fiber shape (for example, staple yarn sizes can be 2.25/2 and 10/1 English cotton count; which equates to deniers of 4703 and 532 respectively), including those uniform or irregular in thickness in the lengthwise direction, the cross-sectional shape of which may be circular, triangular, polygonal, multi-lobal or indefinite, including an L-shape, a T-shape, a Y-shape, a W-shape, an octagonal lobal shape, a flat shape and a dog-bone shape. The fiber according to the present invention may be either solid or hollow.

The polymer fibers comprising polyetherimide described herein have a tenacity of at least about 0.5 g/denier, in another embodiment from about 0.5 g/denier to about 50 g/denier, in yet another embodiment from about 1 g/denier to about 7 g/denier, and in still yet another embodiment from about 1 g/denier to about 3.5 g/denier, as tested according to ASTM-02256-97. The polymer fibers comprising polyetherimide described herein have an elongation at break of at least about 10%, in another embodiment from about 10% to about 50%, in yet another embodiment from about 10% to about 30%, and in still yet another embodiment at least about 30%, as tested according to ASTM-02256-97. The measured elongation varies as a function of the draw ratio of the rollers, where a relatively higher draw ratio results in a relatively lower elongation.

Any final fiber produced according to the claimed invention, may be included in a multifilament yarn including, in addition to, one or more fibers comprising a polyetherimide, other synthetic, organic, inorganic or natural fibers. Other fibers which may be blended with one or more polyetherimide fibers are selected from synthetic fibers selected from the group consisting of nylons, acrylic, modacrylic, PBI, polyesters, polypropylene, polyethylene, latex, PET, PI, polyesters, spandex, sulfar, vivyon, NOMEX, carbon, aramid, ceramic, metal, glass, etc., and mixtures thereof. Natural fibers including but not limited to cellulosic fibers, e.g., cotton, rayon, linen, poly/cotton blends, Tencel, and mixtures thereof, proteinaceous fibers, e.g., silk, wool, related mammalian fibers, and mixtures thereof, long vegetable fibers, e.g., jute, flax, ramie, coir, kapok, sisal, henequen, abaca, hemp, sunn, and mixtures thereof, and natural material in the form or fibers including asbestos, for example.

The fiber may be converted to a yarn form according to any method known in the art, such as a spun yarn manufactured from a ring spinning frame or an open end spinning frame, a filament yarn having a single fiber thickness in a range from 0.001 inch to 0.35 inch (including an ultra-fine, yarn), a soft or hard twisted yarn, a mixed fiber yarn, a false-twist textured yarn (including a draw-false twist textured yarn of POY) or an air jet textured yarn. In this regard, the mixed fiber yarns according to the present invention may be made through such well known processes as fiber-mixing means, such as a mixed-spinning process (including a ciro-spun or a ciro-fil), an entanglement mixing process (wherein yarns having various shrinkages are mixed together), a mixed-twisting process, a composite false-twist process (including an elongation-difference-false-twist process) or a two-feed air jet texturing process.

The high heat polymer, for example polyetherimide, may undergo at least one of several various processes to remove foreign particulate matter of many sizes. The skilled artisan will appreciate that a wide range of methods and apparatus are known in the art and that depending on the size of the particulate matter as well as the end use of the fiber, there will be a variety of different ways of producing a polyimide-containing product that is substantially free of foreign particulate matter. A removal process to remove at least a portion of one or more types of foreign particulate matter to produce a "purified" polymer, where the purified polymer is defined herein as having a reduced concentration of foreign particulate matter.

Known processes for the removing foreign particulate matter from materials include, but are not limited to, for example, a filtration process, an irradiation process, a heating process, a cooling process, a pressurization process, a depressurization process, a chemical addition process, adsorption process, precipitation process, a phase transfer process, and combinations thereof, for at least one of separating, destroying, and converting the foreign particulate matter to remove it. As a specific example of a combined process, the polyetherimide polymer can be dissolved in solvent to a liquid, which is then filtered and then re-solidified to a polymer that is substantially free of foreign particulate matter.

The polymer fiber comprising polyetherimide, according to an embodiment of the present invention, is substantially free of foreign particulate matter greater than about 100 μm in size, in another embodiment greater than about 75 μm in size, in another embodiment, greater than about 50 μm in size, and yet in another embodiment, greater than about 25 μm in size, and in still yet another embodiment, greater than about 10 μm. In another embodiment of the present invention, the fiber is substantially free of foreign particulate matter having a size greater than or equal to about 85% of the diameter of the fiber, in another embodiment greater than or equal to about 50% of the diameter of the fiber, in another embodiment greater than or equal to 25% of the diameter of the fiber, and in yet another embodiment greater than or equal to 10% of the diameter of the fiber.

As described above with respect to FIG. 1, the polymer can be filtered to remove foreign objects. The polymer can be filtered prior to processing into a fiber to remove any particulate matter that may effect any parameter of commercial scale fiber manufacturing process, including speed, volume and quality of fiber produced. The polymer may be filtered to remove particulate matter of any size. The skilled artisan will appreciate that a wide range of methods and apparatus are known in the art and that depending on the size of the particulate matter as well as the end use of the fiber, there will be a variety of different ways of producing a filtered polyimide product.

In one embodiment, the process for making fiber includes filtering the polymer to remove foreign particulate matter so that the polymer is substantially free of foreign particulate matter. The polymer can be filtered prior to processing into a fiber to remove any particulate matter that may effect any parameter of commercial scale fiber manufacturing process, including speed, volume and quality of fiber produced. For example, the polymer used in the fiber of the present invention can be filtered prior to passing the molten polymer through the spinneret, and in another embodiment the polymer comprising polyetherimide can be filtered before or after melting the polymer in the production of fiber.

The skilled artisan will appreciate the multitude of different ways for filtering the polymers of the present invention to allow for the commercial production of the novel fibers of the present invention. The polymer can be filtered at any time prior to, or during the production of the fibers using a variety of apparatus and techniques known in the art.

Filtering the polymer prior to the exit of the polymer from the spinneret or diehead, has the additional advantage of changing the pressure on the polymer (as opposed to fiber) side of spinneret or die head. The pressure on the inside surface of the spinneret can be manipulated to be uniform and constant such that output and quality are maintained for extended periods allowing for long production runs. The pressure on the inside of the spinneret can be maintained at any pressure greater than zero to about 3,000 psi, in another embodiment from about 50 psi to about 1000 psi, in yet another embodiment from about 400 psi to about 800 psi, and in yet another embodiment from about 500 psi to about 600 psi. Depending on the number of holes in the spinneret, this pressure will be distributed among the holes. In another embodiment of the present invention, the pressure will be evenly distributed and the pressure per hole of the spinneret will be approximately 1 psi/hole.

The fiber according to various embodiments of the present invention may be made exclusively of one polyetherimide or may comprise a blend of two or more polymers including a second polyetherimide. Alternatively, polyetherimide co-polymers may be used to make the fibers of the present invention. Fibers of the present invention can also be manufactured from blends of polyimides and polyetherimides with other polymers. The skilled artisan will appreciate the number of polymers currently marketed and that any polymer can be used in association with the present invention that will meet the end use requirements for the fiber.

Similarly, different polyimides and polyetherimides will have different properties and the skilled artisan will appreciate the desirability of blending one or more of the polyimides and/or polyetherimide polymers with another polymers, for example, crystalline or amorphous polymers, or both, to improve the fiber making process or fiber properties of a polymer fiber according to the present invention. The polymer fibers herein can include polymer compositions comprising from about 1% to about 99% of a polymer or polymers different than polyetherimide, and from about 99% to about 1% polyetherimide polymer, and all ranges therebetween. For example, in one embodiment the polymer fiber comprises at least about 50% polyetherimide, in another embodiment, at least about 75% polyetherimide, in yet another embodiment at least about 95% polyetherimide, and still yet another embodiment at least about 99% polyetherimide.

The fiber can include one or more polyetherimides. Thermoplastic polyimides have the general formula (1):

(1)

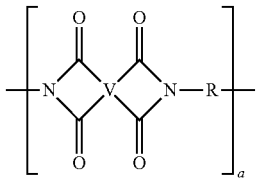

wherein a is more than 1, typically about 10 to about 1,000 or more, or more specifically about 10 to about 500; and wherein V is a tetravalent linker without limitation, as long as the linker does not impede synthesis or use of the polyimide.

Suitable linkers include but are not limited to: (a) substituted or unsubstituted, saturated, unsaturated or aromatic monocyclic and polycyclic groups having about 5 to about 50 carbon atoms, (b) substituted or unsubstituted, linear or branched, saturated or unsaturated alkyl groups having 1 to about 30 carbon atoms; or combinations comprising at least one of the foregoing. Suitable substitutions and/or linkers include, but are not limited to, ethers, epoxides, amides, esters, and combinations comprising at least one of the foregoing. At least a portion of the linkers V contain a portion derived from a bisphenol. Desirably linkers include but are not limited to tetravalent aromatic radicals of structures (2)

(2)

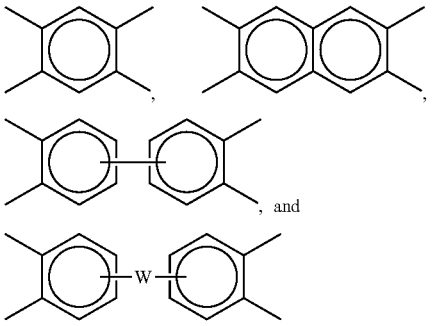

wherein W is a divalent moiety including —O—, —S—, —C(O)—, —$SO_2$—, —SO—, —$C_yH_{2y}$— (y being an integer from 1 to 5), and halogenated derivatives thereof, including perfluoroalkylene groups, or a group of the formula —O—Z—O— wherein the divalent bonds of the —O— or the —O—Z—O— group are in the 3,3', 3,4', 4,3', or the 4,4' positions, and wherein Z includes, but is not limited, to divalent radicals of formulas 3.

(3)

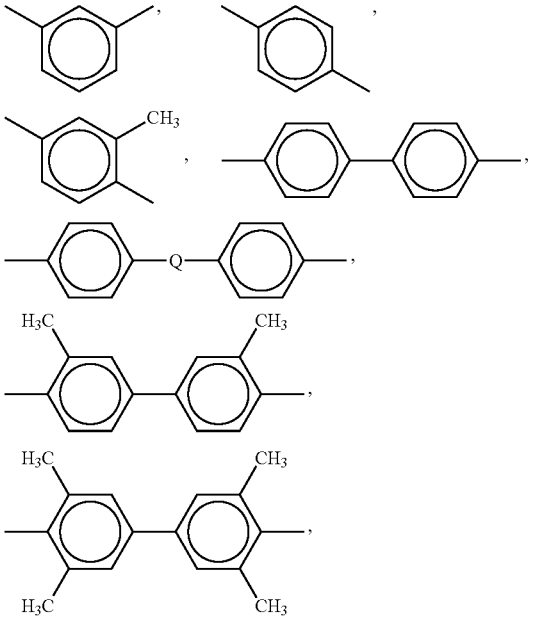

-continued

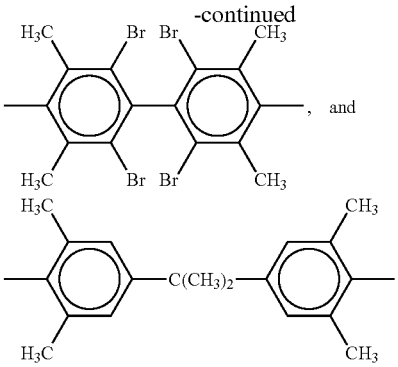

wherein Q includes but is not limited to a divalent moiety including —O—, —S—, —C(O)—, —$SO_2$—, —SO—, —$C_yH_{2y}$— (y being an integer from 1 to 5), and halogenated derivatives thereof, including perfluoroalkylene groups.

R in formula (1) includes but is not limited to substituted or unsubstituted divalent organic radicals such as: (a) aromatic hydrocarbon radicals having about 6 to about 20 carbon atoms and halogenated derivatives thereof, (b) straight or branched chain alkylene radicals having about 2 to about 20 carbon atoms; (c) cycloalkylene radicals having about 3 to about 20 carbon atoms, or (d) divalent radicals of the general formula (4)

(4)

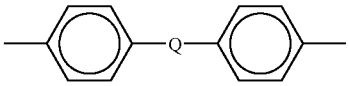

wherein Q includes but is not limited to a divalent moiety including —O—, —S—, —C(O)—, —$SO_2$—, —SO—, —$C_yH_{2y}$— (y being an integer from 1 to 5), and halogenated derivatives thereof, including perfluoroalkylene groups.

Exemplary classes of polyimides include polyamidimides and polyetherimides, particularly those polyetherimides which are melt processable, such as those whose preparation and properties are described in U.S. Pat. Nos. 3,803,085 and 3,905,942.

Exemplary polyetherimide resins comprise more than 1, typically about 10 to about 1,000, or more specifically, about 10 to about 500 structural units, of the formula (5)

(5)

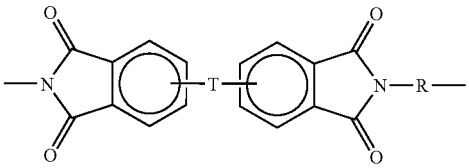

wherein T is —O— or a group of the formula —O—Z—O— wherein the divalent bonds of the —O— or the —O—Z—O— group are in the 3,3', 3,4', 4,3', or the 4,4' positions, and wherein Z includes, but is not limited, to divalent radicals of formula 10 as defined above.

In one embodiment, the polyetherimide may be a copolymer which, in addition to the etherimide units described above, further contains polyimide structural units of the formula (6)

(6)

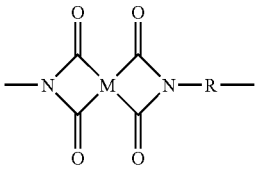

wherein R is as previously defined for formula (1) and M includes, but is not limited to, radicals of formulas (7).

(7)

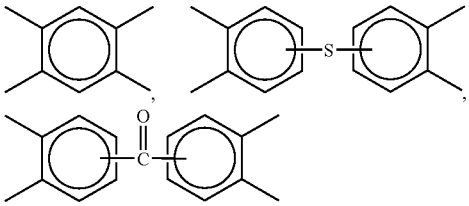

and

The polyetherimide can be prepared by various methods, including, but not limited to, the reaction of an aromatic bis(ether anhydride) of the formula (8)

(8)

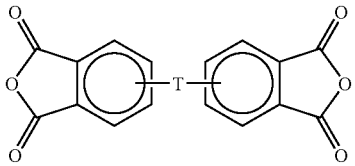

with an organic diamine of the formula (9)

$$H_2N—R—NH_2 \quad (9)$$

wherein R and T are defined in relation to formulas (1) and (5).

Examples of specific aromatic bis(ether anhydride)s and organic diamines are disclosed, for example, in U.S. Pat. Nos. 3,972,902 and 4,455,410. Illustrative examples of aromatic bis(ether anhydride)s of formula (8) include:

2,2-bis[4-(3,4-dicarboxyphenoxy)phenyl]propane dianhydride;

4,4'-bis(3,4-dicarboxyphenoxy)diphenyl ether dianhydride;

4,4'-bis(3,4-dicarboxyphenoxy)diphenyl sulfide dianhydride;

4,4'-bis(3,4-dicarboxyphenoxy)benzophenone dianhydride;

4,4'-bis(3,4-dicarboxyphenoxy)diphenyl sulfone dianhydride;

2,2-bis[4-(2,3-dicarboxyphenoxy)phenyl]propane dianhydride;

4,4'-bis(2,3-dicarboxyphenoxy)diphenyl ether dianhydride;

4,4'-bis(2,3-dicarboxyphenoxy)diphenyl sulfide dianhydride;

4,4'-bis(2,3-dicarboxyphenoxy)benzophenone dianhydride;

4,4'-bis(2,3-dicarboxyphenoxy)diphenyl sulfone dianhydride;

4-(2,3-dicarboxyphenoxy)-4'-(3,4-dicarboxyphenoxy) diphenyl-2,2-propane dianhydride;

4-(2,3-dicarboxyphenoxy)-4'-(3,4-dicarboxyphenoxy) diphenyl ether dianhydride;

4-(2,3-dicarboxyphenoxy)-4'-(3,4-dicarboxyphenoxy) diphenyl sulfide dianhydride;

4-(2,3-dicarboxyphenoxy)-4'-(3,4-dicarboxyphenoxy)benzophenone dianhydride; and, 4-(2,3-dicarboxyphenoxy)-4'-(3,4-dicarboxyphenoxy) diphenyl sulfone dianhydride, as well as various mixtures comprising at least one of the foregoing.

The bis(ether anhydride)s can be prepared by the hydrolysis, followed by dehydration, of the reaction product of a nitro substituted phenyl dinitrile with a metal salt of a bisphenol compound (e.g., BPA) in the presence of a dipolar, aprotic solvent. An exemplary class of aromatic bis(ether anhydride)s included by formula (15) above includes, but is not limited to, compounds wherein T is of the formula (10):

(10)

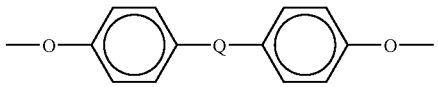

and the ether linkages, for example, are in the 3,3', 3,4', 4,3', or 4,4' positions, and mixtures comprising at least one of the foregoing, and where Q is as defined above.

Any diamino compound may be employed. Examples of suitable compounds are: ethylenediamine, propylenediamine, trimethylenediamine, diethylenetriamine, triethylenetetramine, hexamethylenediamine, heptamethylenediamine, octamethylenediamine, nonamethylenediamine, decamethylenediamine, 1,12-dodecanediamine, 1,18-octadecanediamine, 3-methylheptamethylenediamine, 4,4-dimethylheptamethylenediamine, 4-methylnonamethylenediamine, 5-methylnonamethylenediamine, 2,5-dimethylhexamethylenediamine, 2,5-dimethylheptamethylenediamine, 2,2-dimethylpropylenediamine, N-methyl-bis(3-aminopropyl) amine, 3-methoxyhexamethylenediamine, 1,2-bis(3-aminopropoxy) ethane, bis(3-aminopropyl) sulfide, 1,4-cyclohexanediamine, bis-(4-aminocyclohexyl) methane, m-phenylenediamine, p-phenylenediamine, 2,4-diaminotoluene, 2,6-diaminotoluene, m-xylylenediamine, p-xylylenediamine, 2-methyl-4,6-diethyl-1,3-phenylene-diamine, 5-methyl-4,6-diethyl-1,3-phenylene-diamine, benzidine, 3,3'-dimethylbenzidine, 3,3'-dimethoxybenzidine, 1,5-diaminonaphthalene, bis(4-aminophenyl) methane, bis(2-chloro-4-amino-3,5-diethylphenyl) methane, bis(4-aminophenyl) propane, 2,4-bis(b-amino-t-butyl) toluene, bis (p-b-amino-t-butylphenyl) ether, bis(p-b-methyl-o-aminophenyl) benzene, bis(p-b-methyl-o-aminopentyl) benzene, 1,3-diamino-4-isopropylbenzene, bis(4-aminophenyl) sulfide, bis(4-aminophenyl) sulfone, bis(4-aminophenyl) ether and 1,3-bis(3-aminopropyl) tetramethyldisiloxane. Mixtures of these compounds may also be present. Desirably, the diamino compounds are aromatic diamines, especially m- and p-phenylenediamine and mixtures comprising at least one of the foregoing.

In one embodiment, the polyetherimide resin comprises structural units according to formula 6 wherein each R is independently p-phenylene or m-phenylene or a mixture comprising at least one of the foregoing and T is a divalent radical of the formula (11)

(11)

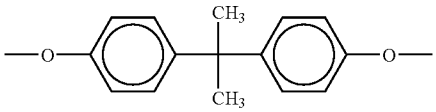

Included among the many methods of making the polyimides, particularly polyetherimides, are those disclosed in U.S. Pat. Nos. 3,847,867; 3,850,885; 3,852,242; 3,855,178; 3,983,093; and, 4,443,591.

The reactions can be carried out employing solvents, e.g., o-dichlorobenzene, m-cresol/toluene and the like, to effect a reaction between the anhydride of formula (8) and the diamine of formula (9), at temperatures of about 100° C. to about 250° C. Alternatively, the polyetherimide can be prepared by melt polymerization of aromatic bis(ether anhydride)s (8) and diamines (9) by heating a mixture of the starting materials to elevated temperatures with concurrent stirring. Generally, melt polymerizations employ temperatures of about 200° C. to about 400° C. Chain stoppers and branching agents may also be employed in the reaction.

When polyetherimide/polyimide copolymers are employed, a dianhydride, such as pyromellitic anhydride, is used in combination with the bis(ether anhydride). The polyetherimide resins can optionally be prepared from reaction of an aromatic bis(ether anhydride) with an organic diamine in which the diamine is present in the reaction mixture at less than or equal to about 0.2 molar excess. Under such conditions the polyetherimide resin may have less than or equal to about 15 microequivalents per gram (μeq/g) acid titratable groups, or, more specifically less than or equal about 10 μeq/g acid titratable groups, as shown by titration with chloroform solution with a solution of 33 weight percent (wt %) hydrobromic acid in glacial acetic acid. Acid-titratable groups are essentially due to amine end-groups in the polyetherimide resin.

One route for the synthesis of polyetherimides proceeds through a bis(4-halophthalimide) having the following structure (12):

(12)

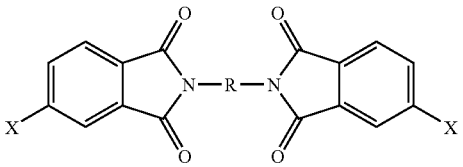

wherein R is as described above and X is a halogen. The bis(4-halophthalimide) wherein R is a 1,3-phenyl group (13) is particularly useful.

(13)

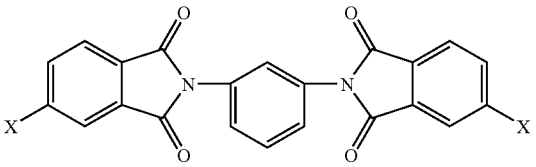

Bis(halophthalimide)s (12) and (13) are typically formed by the condensation of amines, e.g., 1,3-diaminobenzene with anhydrides, e.g., 4-halophthalic anhydride (14):

(14)

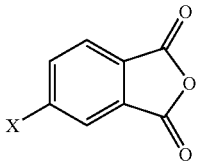

Polyetherimides may be synthesized by the reaction of the bis(halophthalimide) with an alkali metal salt of a bisphenol such as bisphenol A or a combination of an alkali metal salt of a bisphenol and an alkali metal salt of another dihydroxy substituted aromatic hydrocarbon in the presence or absence of phase transfer catalyst. Suitable phase transfer catalysts are disclosed in U.S. Pat. No. 5,229,482. Suitable dihydroxy substituted aromatic hydrocarbons include those having the formula (15)

$$OH\text{-}A^2\text{-}OH \quad (15)$$

wherein $A^2$ is a divalent aromatic hydrocarbon radical. Suitable $A^2$ radicals include m-phenylene, p-phenylene, 4,4'-biphenylene, and similar radicals.

Representative polyetherimides are those produced under the ULTEM® trademark, including, but not limited to ULTEM® 1000 (number average molecular weight (Mn) 21,000 g/mole; Mw 54,000 g/mole; dispersity 2.5), ULTEM® 1010 (Mn 19,000 g/mole; Mw 47,000 g/mole; dispersity 2.5) and ULTEM® 9011 (Mn 19,000 g/mole; Mw 47,000 g/mole; dispersity 2.5) resin by GE plastics, Pittsfield, Mass., in the United States of America. ULTEM® type polyetherimides are described in detail in U.S. Pat. Nos. 3,847,867; 4,650,850; 4,794,157; 4,855,391; 4,820,781; and, 4,816,527, which are hereby incorporated by reference herein in their entirety as though set forth in full.

The polyetherimide resin can have a weight average molecular weight (Mw) of about 1,000 to about 1,000,000 grams per mole (g/mole), more specifically a Mw of about 5,000 g/mole to about 500,000 g/mole, and still more specifically from about 10,000 g/mole to about 75,000 g/mole as measured by gel permeation chromatography, using a polystyrene standard.

Viscosity data for polyetherimides useful as fibers according to the present invention is calculated according to the equation: melt flow index (MFI)×10=melt flow rate (MFR) according to ASTM D1238 (volume 08/2001) with the test run at 337° and 6.6 kgf Some of that melt flow rate is provided below:

ULTEM® 9011: MFR 16-20 g/10 min
ULTEM® 1040: MFR 50-111 g/10 min
ULTEM® 1010: MFR 16-20 g/10 min
ULTEM® 1000: MFR 7-11 g/10 min The melt index of the polymer comprising polyetherimide and as measured according to ASTM 1238 can range from about 0.5 to about 12, in another embodiment from about 1 to about 8, in another embodiment, from about 1.5 to about 2.5, and in yet another embodiment, from about 1.8 to about 2.2, and all ranges therebetween. The melt index range will depend on the composition of the polymer comprising polyetherimide and should not be too low as to be too viscous for uniformly passing through the holes of the spinneret, and should not be to high so as to lose melt strength or compromise the physical properties of the fiber produced, a as can be determined by one of ordinary skill in the art.

Typical drying conditions for drying the polymer having a melt temperature that ranges between 180° C. and 500° C. are well within the knowledge of the skilled artisan. For example, polyetherimide polymer is dried by heating the polymer to about 300° C. for about four to twelve hours. Drying may be achieved at an extruder before it enters the extruder barrel to be melted.

As described above, the scope of the present inventions is intended to cover fibers manufactured from blends of polyimides and polyetherimides with other polymers. The skilled artisan will appreciate the number of polymers currently marketed and that any polymer can be used in association with the present invention that will meet the end use requirements for the fiber. Similarly, different polyimides and polyetherimides will have different properties and the skilled artisan will appreciate the desirability of blending one or more of the polyimides and/or polyetherimide of the present invention with another polymer to improve the fiber making or fiber properties of any polymer to be blended.

Amounts of adjunct ingredients effective to impart, or improve a desirable fiber property such as, brightness of color, strength, cleanability, flame retardance, colorfastness, or dyability. For example, one or more ingredients from the following classes of ingredients may be added to the fiber: perfume, odor control agent, antimicrobial active and/or preservative, surfactant, optical brightener, antioxidant, chelating agent including aminocarboxylate chelating agent, antistatic agent, dye transfer inhibiting agent, fabric softening active, and/or static control agent.

The final fiber produced according to the example embodiments of the present invention described above can have a variety of properties depending on the polymer, and if polyetherimide then the type of polyetherimide, the processing conditions, and the desired end use. For example, as a general observation at the time of the filing of the present invention, and without intending to be bound in any way, as the melt index of polyethrimide increases, the tenacity trends downward.

EXAMPLES

The following examples are included to provide additional guidance to those skilled in the art of practicing the claimed invention. These examples are provided as representative of the work and contribute to the teaching of the present invention. Accordingly, these examples are not intended to limit the scope of the present invention in any way.

Experimental runs were conducted to evaluate the feasibility of producing polyetherimide fiber at a higher output rate and to observe the impact of changes in the various processing. Polyetherimide resin, specifically, ULTEM® 9011 in the form of pellets, available from GE Plastics, Pittsfield, Mass., and which had melt index of approximately 1.8 to 2.2 were dried at 300° C. for at about 12 hours prior to extrusion. The pellets were fed at a feed rate of 1 to 10 Kg/hr through a one-inch (1") single screw extruder (L/D=24/1) and the actual melt temperature of the polymer ranged between about 340° C. and about 400° C. The pellets were fed at a feed rates of 1 to 10 Kg/hr through a one inch (1") single screw extruder (L/D=24/1). The actual melt temperature of the polymers ranged between about 340° C. and about 400° C. The polyetherimide was extruded through a metering pump, a pack top, and then was filtered before the molten polymer flowed through the holes of the spinneret to produce fiber. The smallest screen hole sizes of the screen pack were approximately 25 microns. In the four examples described below polyetherimide fibers were produced at an output rate of up to about 80 pounds/hour depending upon the denier of the fiber produced. The fiber bundle exiting the spinneret were quenched by air which had velocity range of 0.1 to 10 meters per second. Various changes were made to the cooling conditions as described below. The range of processing parameters that were used to produce polyetherimide fiber wound onto coils is summarized in Table I below.

TABLE I

| | | Ex. 1 | Ex. 2 | Ex. 3 | Ex. 4 |
|---|---|---|---|---|---|
| Material | | ULTEM ® 9011 | ULTEM ® 9011 | ULTEM ® 9011 | ULTEM ® 9011 |
| Color | | 100 | 100 | 100 | 100 |
| Lot | | A | A | B | C |
| denier per filament | | — | — | — | 7.8 |
| Spinneret hole dia. | mm | 0.7 | 0.45 | 0.45 | 0.45 |
| Holes/spinneret | | 637 | 637 | 637 | ~570(637)* |
| Extruder Drive | % | 50 | 50 | 40-56 | 80 |
| Pressure | psi | 1600 | 1600 | 1600 | 1600 |
| Zone 1 | ° C. | 350 | 350 | 350 | 350 |
| Zone 2 | ° C. | 354 | 354 | 370 | 360 |
| Zone 3 | ° C. | 377 | 377 | 407 | 397 |
| Head T | ° C. | 350-390 | 380 | 410 | 410 |
| Melt T | ° C. | 350-390 | 380 | 402-405 | 401 |
| R&L Melt Pumps | rpm | 25 | 25-27 | 12-21 | 30 |
| Head Pressure | psi | — | 600 | 350 | 630 |
| Quench T | ° C. | 11-13 | 11 | 10-23 | 12 |
| Quench Velocity (blower) | rpm | 750-1282 | 805 | 412-900+ | 1000 |
| Room T | ° C. | 18-23 | 18 | 20-23 | 25.5 |
| Godets Roll T 1 | ° C. | 40 | 120 | 100-150 | 133 |
| Roll Speed 1 | rpm | 19-24 | 15.9 | 12-25 | 25.2 |
| Draw Ratio | % | 0 | 0 | 0 | 31 |

*~70 holes of 637 were plugged, resulting in ~577 filaments

Example 1

Polyetherimide fibers were produced using a spinneret having 637 holes of a diameter of 0.7 millimeters per the processing conditions described in Table I. Quench air was blown through a rectifier to evenly distribute the airflow directed to the fiber bundle. The airflow and contained by sidewalls extending from the rectifier such that the width between the sidewalls (40 cm) was greater than width of the fiber bundle (25 cm) exiting the spinneret. The process conditions caused random fibers to solidify, break away, and drop from the bundle along the air flow-front interface (i.e. leading edge) areas of the fiber bundle.

Example 2

Polyetherimide fibers were produced using a spinneret again having 637 holes of a diameter of 0.45 millimeters and otherwise similar extrusion conditions as in Example 1 and as listed under Ex. 2 of Table I. In addition, cardboard baffles, or protrusions, were attached to the sidewalls which ran parallel to the flow of the fiber bundle and which extended outward from the rectifier. The baffles extended from the sidewalls such that the distance between the sidewalls was approximately equal to the distance between the edges of the spinneret, and the baffles were positioned laterally between the rectifier and the spinneret. Improvements were made over Example 1 in that a fewer number of strands were dropped.

Example 3

Polyetherimide fibers were produced with a spinneret that had 637 holes with diameter of 0.45 millimeters and otherwise similar extrusion conditions as in the examples above and as listed under Ex. 3 of Table I. The screen pack was changed in an attempt to increase the back pressure of flow through the spinneret. The filter screens were changed to a fine screen pack which included a screen having holes of approximately 15 microns (screen pack configuration 20/60/325/200×400). The spinneret was also modified to plug holes in the front corners where the fibers were dropped. In addition, to facilitate cooling, a vacuum was introduced and mounted opposite the quench air entrance to increase the cross-flow of air through the fibers. The finer screen pack caused a buildup to be produced on the face of the spinneret possibly as a result of shear degradation of the polyetherimide polymer. The build-up accumulated around the perimeter of the holes and the build-up grabbed the fibers and caused the fibers to curl and break. The vacuum appeared to improve the cooling to a point at which the suction of air at high speeds caused fibers to drop and/or caused fibers that were otherwise broken to be pulled toward the vacuum while interrupting the flow of neighboring filaments.

Example 4

Polyetherimide fibers were produced according to the extrusion conditions listed under Ex. 4 of Table I. The same spinneret sized for 637 holes with diameter of 0.45 millimeters as described above with regard to Examples 2 and 3 was used, however 70 holes of the spinneret holes were plugged in a configuration that formed two substantially circular areas as shown and described in FIG. 2 above. The baffles which extended from the sidewalls and aligned with the edges of the spinneret as described in Example 2 moved to a different lateral position such that they approximately aligned with air flow-front interface (i.e. leading edge) of the fiber bundle as shown in FIG. 2. These changes improved the fiber processing, and fiber was wound on the spool for 10 minutes.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A process for producing polymer fiber comprising:

melting a polymer having a melt temperature that ranges from about 300° C. to about 425° C. to produce a molten polymer;

filtering the polymer through a screen having screen hole openings, wherein the size of the hole openings of the screen are at least about 15 microns;

passing the molten polymer through a spinneret comprising a plurality of about 60 to about 850 hole openings, said spinneret having at least three regions two of which have a different hole density than the first to produce a fiber bundle comprising a plurality of fibers having at least two cross-sectional regions of different polymer fiber density, and the region that has a relatively lower polymer filament density reduces heat build-up within the fiber bundle; and contacting the fiber bundle with a cooling medium to provide a uniform velocity distribution of cooling medium across the path of the fiber bundle as it emerges from the spinneret, the cooling medium having a temperature that ranges from about 0° C. to about 80° C.

wherein the polymer comprises polyetherimide and wherein the fiber bundle comprises a cross-sectional first region surrounding a cross-sectional second region, and a cross sectional third region, the second region and third region having a fiber density that is less than the fiber density of the first region.

2. The process of claim 1, wherein the plurality of fibers of the fiber bundle are cooled at a substantially even cooling rate.

3. The process of claim 1, further comprising directing the cooling medium toward the fiber bundle through a cooling zone as the cooling medium contacts the fiber bundle, and wherein the width of the cooling zone is up to about 20% greater than the size of the bundle width.

4. The process of claim 3, wherein the size of the cooling zone width is substantially equal to the size of the bundle width.

5. The process of claim 3, wherein the cooling medium is directed between a first flow guide and a second flow guide separated by a distance that defines the cooling zone width, and the first flow guide and the second flow guide are positioned at a location between a source of cooling medium and the fiber bundle.

6. The process of claim 5, wherein the first flow guide and the second flow guide which define the cooling zone width are positioned substantially along the leading edge of the fiber bundle.

7. The process of claim 5, wherein:

the cooling medium flows through a rectifier and flows between a first sidewall and a second sidewall which extend from the rectifier alongside the fiber bundle; and the first flow guide and the second flow guide protrude from the first opposing sidewall and the second opposing sidewall, respectively.

8. The process of claim 1, wherein the cooling medium is a gas.

9. The process of claim 8, wherein the gas is air.

10. The process of claim 8, wherein the fiber bundle is contacted by a gaseous cooling medium having a velocity that ranges from about 0.01 to about 10 meters per second.

11. The process of claim 1, wherein the fiber output rate ranges from about 100 meters per minute to about 5000 meters per minute.

12. The process of claim 1, wherein the polymer comprises polyetherimide having a melt index that ranges from about 1 gram/10 minutes to about 8 grams/10 minutes per ASTM D1238.

13. The process of claim 1, further comprising providing a quench air entrance on one side of a fiber bundle drawing a vacuum on the side of the fiber bundle opposite the quench air entrance to increase the cross-flow of cooling medium passing through the fiber bundle.

14. The process of claim 1, wherein the area of the cross-sectional second region is less than the area of the cross-sectional first region.

15. The process of claim 1, wherein the fiber density of the second region is zero.

16. The process of claim 1, wherein the fiber has a tenacity of at least about 0.5 g/denier or greater according to ASTM 2256-97.

17. The process of claim 1, wherein the fiber has an elongation at break of at least 10% according to ASTM-02256-97.

18. The process of claim 1, further comprising maintaining a uniform and constant pressure on an inside surface of the spinneret.

19. A process for producing polymer fiber, the process comprising:

melting a polymer having a melt temperature that ranges from about 300° C. to about 425° to produce a molten polymer;

filtering the polymer through a screen having screen hole openings, wherein the size of the hole openings of the screen are at least about 15 microns, then;

passing the molten polymer through a spinneret comprising a plurality of about 100 to about 800 hole openings, said spinneret having at least three regions two of which have a different hole density than the first to produce a fiber bundle comprising a plurality of fibers having at least two cross-sectional regions of different polymer fiber density, and the region that has a relatively lower polymer filament density reduces heat build-up within the fiber bundle; and wherein the fiber bundle comprises a cross-sectional first region surrounding a cross-sectional second region and a cross-sectional third region, the cross-sectional second region and third region having a fiber density that is less than the fiber density of the cross-sectional first region and wherein the polymer comprises polyetherimide.

20. The process of claim 19, wherein the area of the cross-sectional second region is less than the area of the cross-sectional first region.

21. The process of claim 19, wherein the area of the cross-sectional second region is at least about 5% of the area of the cross-sectional first region.

22. The process of claim 19, wherein the fiber density of the cross-sectional second region is less than about 90% of the fiber density of the first region.

23. The process of claim 19, wherein the fiber density of the cross-sectional second region is zero.

24. The process of claim 19, wherein the number of fibers in the fiber bundle ranges from 50 to 1000.

25. The process of claim 19, wherein the polymer fiber density of the third region is less than about 90% of the fiber density of the first region.

26. The process of claim 19, wherein the fiber density of the third region is zero.

27. The process of claim 19, wherein the area of the third region is at least about 5% of the area of the first region.

28. The process of claim 19, wherein the polymer filaments of the first region are substantially evenly spaced apart.

29. The process of claim 19, wherein the polymer filaments of the first region are irregularly spaced apart.

30. The process of claim 19, wherein the cross-sectional second region is substantially circular in shape.

31. The process of claim 19, wherein the pressure exerted by the polymer on the spinneret is substantially uniform across the inside surface of the spinneret.

32. The process of claim 19, wherein the polymer comprises polyetherimide having a melt index that ranges from about 1.5 grams/10 minutes to about 2.5 grams/10 minutes.

33. The process of claim 19, wherein the polymer comprises at least 50% polyetherimide.

34. The process of claim 19, wherein the polymer comprises at least 99% polyetherimide.

35. The process of claim 19, further comprising contacting the fiber bundle with a cooling medium having a substantially uniform flow distribution across a bundle width of the fiber bundle as it emerges from the spinneret, the cooling medium having a temperature that ranges from about 0° C. to about 80° C.

36. The process of claim 35, wherein the cooling medium is a gas.

37. The process of claim 36 wherein the gas is air.

38. The process of claim 35, wherein the velocity of the cooling medium directed toward the fiber bundle ranges from 0.01 meters per second to 10 meters per second.

39. The process of claim 35, wherein the cooling medium is directed toward the fiber bundle through a cooling zone as it contacts the fiber bundle, and the width of the cooling zone is up to 10% greater than the size of the bundle width.

40. The process of claim 39, wherein the size of the cooling zone width is substantially equal to the size of the bundle width.

41. The process of claim 19, wherein the diameter of the fibers of the fiber bundle can range from 0.00001 millimeters to 2 millimeters.

42. The process of claim 19, wherein the fiber has a tenacity of at least about 0.5 g/denier or greater according to ASTM 2256-97.

43. The process of claim 19, wherein the fiber has an elongation at break of at least 10% according to ASTM-02256-97.

44. The process of claim 19, wherein the fiber output rate ranges from about 100 meters per minute to about 5000 meters per minute.

45. The process of claim 19, wherein the cooling medium flowing through the fiber bundle has a temperature that ranges from about 10° C. to about 24° C.

46. The process of claim 35, wherein flow direction of the cooling medium flow is in the direction that is transverse to the path of travel of the fiber bundle as it emerges from the spinneret.

* * * * *